US006828945B2

(12) United States Patent
Martikkala

(10) Patent No.: US 6,828,945 B2
(45) Date of Patent: Dec. 7, 2004

(54) ENHANCEMENT OF THE FIELD PATTERN OF A DEVICE FOR TRANSFERRING ELECTROMAGNETIC WAVES

(75) Inventor: Risto Martikkala, Oulu (FI)

(73) Assignee: Nokia Corporation, Espoo (FI)

( * ) Notice: Subject to any disclaimer, the term of this patent is extended or adjusted under 35 U.S.C. 154(b) by 0 days.

(21) Appl. No.: 10/258,500

(22) PCT Filed: Mar. 5, 2001

(86) PCT No.: PCT/EP01/02472

§ 371 (c)(1),
(2), (4) Date: Nov. 26, 2002

(87) PCT Pub. No.: WO02/071546

PCT Pub. Date: Sep. 12, 2002

(65) Prior Publication Data

US 2004/0046696 A1 Mar. 11, 2004

(51) Int. Cl.[7] ..... H01Q 9/28
(52) U.S. Cl. ..... 343/795; 343/700 MS
(58) Field of Search ..... 343/795, 810, 343/816, 817, 700 MS

(56) References Cited

U.S. PATENT DOCUMENTS 3,114,913 A 12/1963 Alford
5,710,569 A 1/1998 Oh et al. ..... 343/817

FOREIGN PATENT DOCUMENTS

| | | | |
|---|---|---|---|
| DE | 195 09 906 A1 | 9/1996 | ..... H01Q/21/00 |
| EP | 0 973 231 A2 | 1/2000 | |
| JP | 62227202 | 3/1988 | ..... H01Q/21/08 |
| WO | WO 00/51201 | 8/2000 | ..... H01Q/1/52 |

*Primary Examiner*—Hoang V. Nguyen
(74) *Attorney, Agent, or Firm*—Cohen, Pontani, Lieberman & Pavane

(57) ABSTRACT

A device for transferring electromagnetic waves, comprising at least one element (32, 33) for transceiving electromagnetic waves, wherein such an element includes a member for transceiving electromagnetic waves and a member for feeding said transceiving member, and both members are electrically connected with each other, and a conductor strip (101; SDCS, MDCS) which is bent around each of said transceiving elements so that sources of unwanted radiation pattern along said transceiving elements are covered, said conduct or strip having a flat shape so that regarding its cross section, a thickness perpendicular to said transceiving element is small with respect to a dimension of said conductor strip parallel to said transceiving element, the extension of which dimension also suffices to cover said not wanted sources, wherein each of said conductor strips is grounded at both ends to a common electrical point.

12 Claims, 3 Drawing Sheets

ENHANCEMENT OF THE FIELD PATTERN OF A DEVICE FOR TRANSFERRING ELECTROMAGNETIC WAVES

PRIORITY CLAIM

This is a national stage of PCT application No. PCT/EP01/02472, filed on Mar. 5, 2001. Priority is claimed on that application.

FIELD OF THE INVENTION

The present invention relates to a device for transferring electromagnetic waves, and particularly to a directivity enhancement of its field pattern. More particularly, the present invention can be advantageously applied to a vertical polarization antenna by enhancing the front-to-up & down ratio (vertical pattern) thereof.

RELATED BACKGROUND ART

In the existing communication networks of mobile telephony of the second generation, it is the case that the cellular coverage of an area is formed by the transferring devices of the base station subsystem. Namely, antennas for radio transmission are installed at a same location with the other elements of the communication network. Therein, it is appropriate to mount these antennas such that they do not influence each other, while having a good transmission efficiency to/from a respective counterpart. Actually, the antennas are preferred to be installed on top of each other as, for example, a Location Measurement Unit (LMU) antenna below or above a Base Transceiver Station (BTS) antenna.

As is clear from the above, these antennas installed on top of each other need to be sufficiently isolated so that they do not influence each other. That is, the beam angle of the vertical field pattern should be formed narrow. When referring to FIG. 1(*b*) showing a prior art field pattern emitted by an antenna 11, it is apparent that this antenna 11 influences any antenna which would be mounted above or below at a too near distance.

There are some measures known to improve the pattern angle such as to increase the numbers of the radiators of the antenna, to provide longer omni monopoles, to combine radiators in phase, to add upper and lower groundplanes (reflectors) with resonator 1/N-wave pin's at the edge, wherein these upper and lower groundplanes can be also RF-traps by connecting two planes together at close 1/N-wave distance.

However, every of these measures suffers from at least one severe drawback. Namely, most of them lead to an increase in the size of the antenna or are simply very difficult to handle. In addition, some are visually not acceptable.

SUMMARY OF THE INVENTION

Therefore, it is an object of the present invention to provide a device for transferring electromagnetic waves which is free from the above drawbacks.

According to the present invention, this object is solved by providing a device for transferring electromagnetic waves, comprising at least one element for transceiving electromagnetic waves, wherein such an element includes a member for transceiving electromagnetic waves and a member for feeding said transceiving member, and both members are electrically connected with each other, and a conductor strip which is bent round each of said transceiving elements so that sources of unwanted radiation pattern along said transceiving elements are covered, said conductor strip having a flat shape so that regarding its cross section, a thickness perpendicular to said transceiving element is small with respect to a dimension of said conductor strip parallel to said transceiving element, the extension of which dimension also suffices to cover said unwanted sources, wherein each of said conductor strips is grounded at both ends to a common electrical point.

With such a structure, the field pattern of the system is improved in a way that the non desired polarization pattern in a direction perpendicular to the plane of the conductor strips becomes negligible.

As advantageous modifications, the distance between said conductor strip and a corresponding source of unwanted radiation can be chosen to be less than half the width of said strip. This is considered to be the maximum effective distance. Regarding a minimum distance, the arrangement should be such that neither the performance nor the device matching is affected by capacitive coupling.

The device for transferring electromagnetic waves may further comprise a grounding element which in case of directional device can act as a reflector with respect to the transceived electromagnetic waves.

In case if several transceiving members are present in the present device, they are combined in phase, and the conductor strips are grounded at both ends by being directly connected to said grounding element.

Instead of a direct connection, the conductor strips may also be coupled to ground, for example capacitively.

In order to take a phase difference between several transceiving elements into account, the conductor strips are preferably electrically connected together through a suitable phase shift according to this phase difference of the transceiving elements.

With respect to the structure of the device for transferring electromagnetic waves, one or more of said transceiving elements can comprise multiple transceiving members and one feeding member electrically connected thereto. Then, the distance between said conductor strip and a corresponding source of unwanted radiation is less than half the width of said strip at each of said sources.

Of course, the device for transferring electromagnetic waves may form an antenna, wherein said transceiving members are dipoles and said multiple transceiving members are multiple dipoles. As examples for antennas in the present field, a vertical polarization antenna or a horizontal polarization antenna are provided.

The device according to the present invention as well as its modifications solve the above stated problem without increasing the size of the device. Further, additional costs will be very low in comparison to the prior art, making the applicability of the present invention high. Moreover, the present invention can easily be applied to already existing and mounted device structures.

BRIEF DESCRIPTION OF THE DRAWINGS

The present invention will become more apparent from the following detailed description of the preferred embodiments when taken in conjunction with the accompanying drawings, in which FIG. 1(*a*) shows the vertical field pattern of a vertical polarization antenna according to the present invention;

FIG. 2(*b*) shows a comparative measurement of the vertical field pattern of the same vertical polarization antenna without conductor strips.

DESCRIPTION OF THE PREFERRED EMBODIMENTS

In the following, a description is given of what is presently considered as preferred embodiments of the present invention. With respect to that, the enhancement of the vertical field pattern of a vertical polarization antenna by applying the present invention is described.

Regarding such an antenna, it should be understood that an antenna is suitable for emitting electromagnetic waves as well as for receiving electromagnetic waves. Thus, this property is expressed in the present context as "transceiving". Consequently, the elements which are responsible for the transceiving action are named "transceiving elements". These elements may by comprised of several members. In case of an antenna, this would be the dipoles and their feeders.

Figure 3:
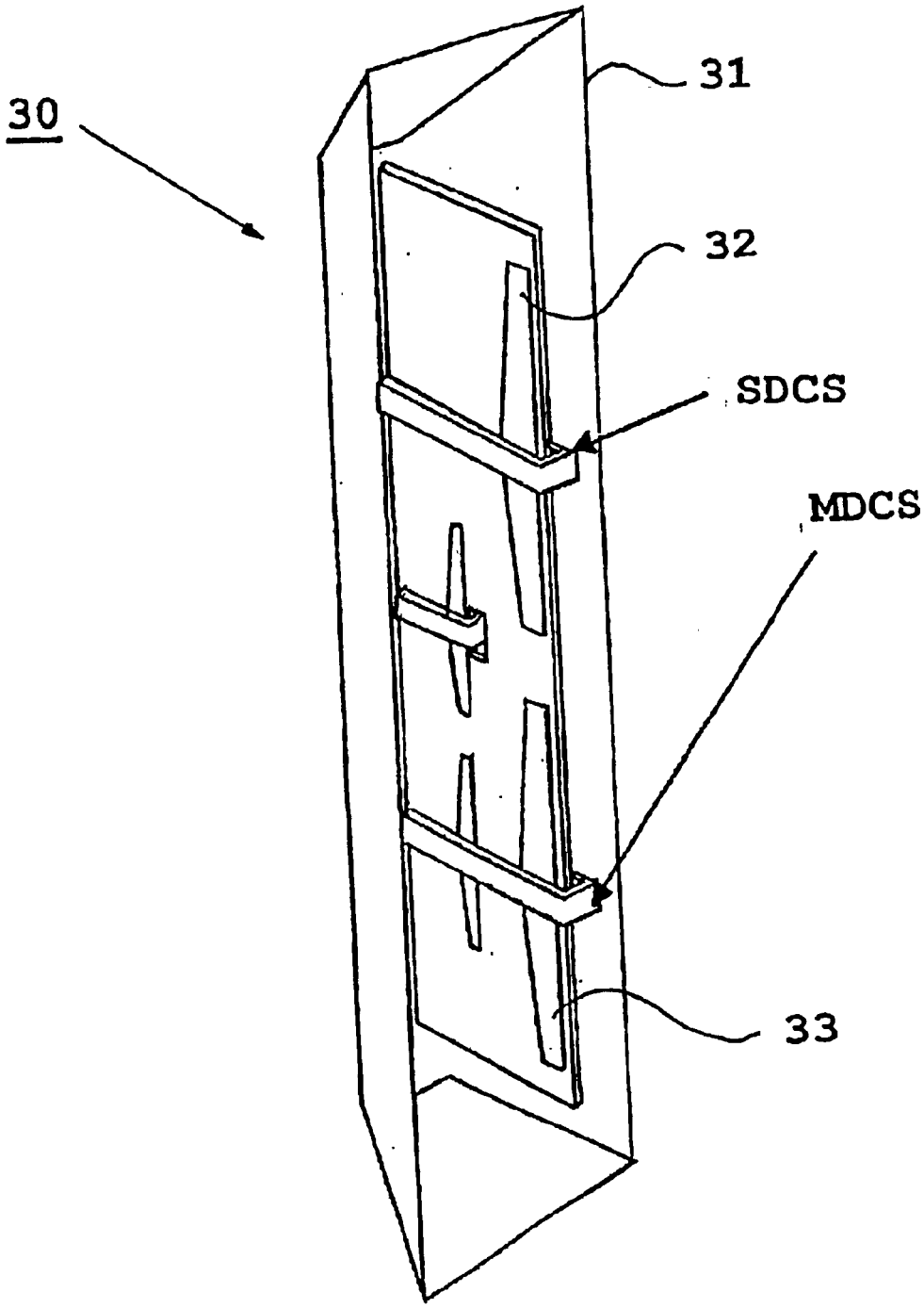
FIG. 3 shows a vertical polarization antenna implementation of Single Dipole Conductor Strip (SDCS) and Multi Dipole Conductor Strips (MDCS) according to the present invention.

Referring now to FIG. 3, there is shown a vertical polarization antenna 30. The antenna comprises a casing 31, single dipoles 32 and multiple dipoles 33.

To enhance the vertical field pattern of the antenna, conductor strips SDCS, MDCS are installed horizontally around the radiators 32, 33 to cover the feeder connection and any transceiving element problem area e.g. the PCB transmission line connection which is physically at the middle between the dipole arms. Such problem areas are sources of radiation which contribute to the unwanted parts of the field pattern as described above. Hence, according to the present invention, all such sources are covered by such a conductor strip.

In order to obtain this, these conductor strips are bent around each of said transceiving elements including at least one dipole and its feeding member. The conductor strips SDCS, MDCS itself are aligned to the radiators 32, 33 to be in the main propagation plane of the electromagnetic wave which is transceived by a respective radiator 32, 33.

The conductor strip comprises a flat shape, i.e. with respect to its cross section, its thickness regarding its radial direction is thin compared to the thickness in the direction parallel to the dipole. The latter thickness is sufficient if the source of unwanted radiation is covered, e.g. the dipole arms feeder connection point.

The electrical length of the dipole may become shorter, and compensation may be required by extending the dipole arms.

The maximum effective distance between a conductor strip and a dipole is half the width of the strip. The closest distance is such that the transceived signal should not be affected by the strip due to capacitive coupling. This distance is to be understood as the closest distance which lies between a point where the radiator 32, 33 is connected to the feeding member and a point of the conductor strip SDCS, MDCS which is next to that point.

This however means that in the multiple dipole case, one conductor strip may be enough if the above distance condition is held for each "bad" source, as for example the dipole connection.

Furthermore, the conductor strips are grounded at both ends to a common electrical point e.g. by being connected to the grounded backplane (the reflector). Alternatively, the conductor strips can also be connected together at both ends e.g. with a separate horizontal conductor. Any connection in this context means an electrical connection, i.e. the different kinds of electrical coupling are also included.

Specifically, if the transceiving elements (the radiators 32, 33) are combined in phase, then the strips can be grounded at both ends by being directly connected to a grounding element which can be the reflector. However, if the transceiving element exhibit a phase difference, the conductor strips are electrically connected together through a suitable phase shift according to this phase difference.

Figure 1A:
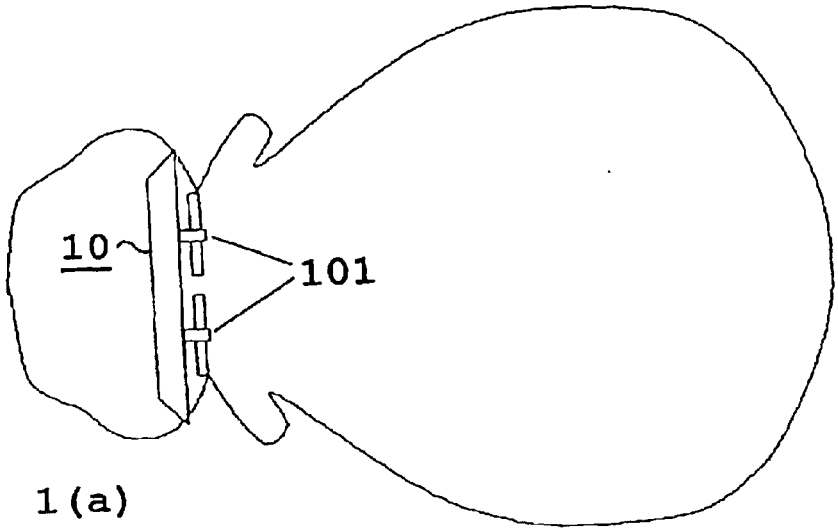
FIG. 1(*b*) shows the vertical field pattern of a comparative known vertical polarization antenna.
Figure 1B:
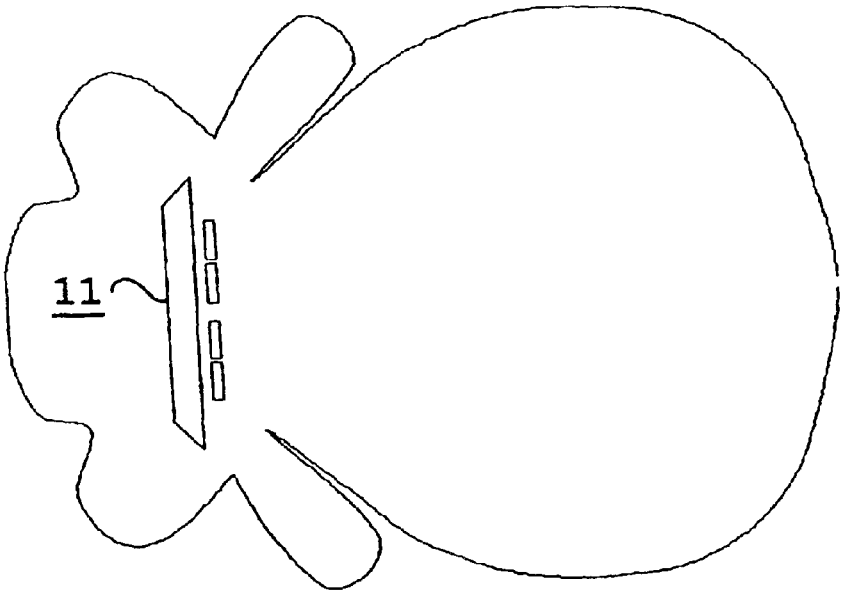
FIG. 1(b) (PRIOR ART)

With such a structure where an antenna 10 has the above described conductor strips 101, a vertical field pattern of the polarization is obtained as is shown in FIG. 1(*a*). From the comparison to FIG. 1(*b*) showing a vertical field pattern according to the prior art, it becomes evident that according to the present invention the unwanted parasitic radiation pattern of the feeder connection and the close by ends of the dipole arms is minimized and zero-elements in this vertical field pattern of the polarization in the up and down direction are much more stronger.

As can be understood from the above, the conductor strips MDCS of the multiple dipoles can be connected together (e.g. via the reflector) for shorting the vertical pattern signal from/to up and down in 180° phase shift of the dipole distance. The wanted horizontal pattern signal is coupled in phase and is not affected.

In fact, if the conductor strips SDCS, MDCS are connected together with the common reflector, the dipoles need to be connected in phase. This however improves the effect even more, since the $\lambda/2$ dipoles are normally placed on top of each other at a $\lambda/2$ distance for optimum vertical pattern, and thus a second conductor strip is forming a short-connection for the signals from/to the "non-wanted" direction (up/down), but the front direction signals are not affected.

Figure 2A:
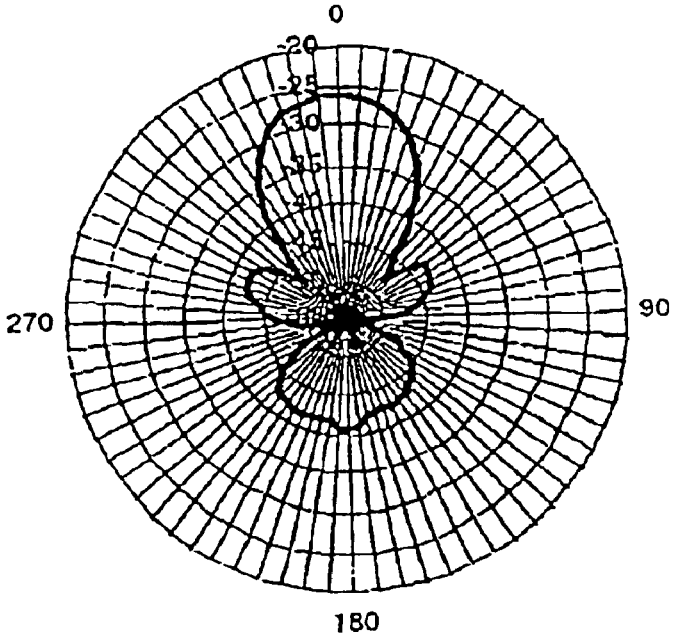
FIG. 2(*a*) shows a measurement of the vertical field pattern of a vertical polarization antenna with conductor strips.
Figure 2B:
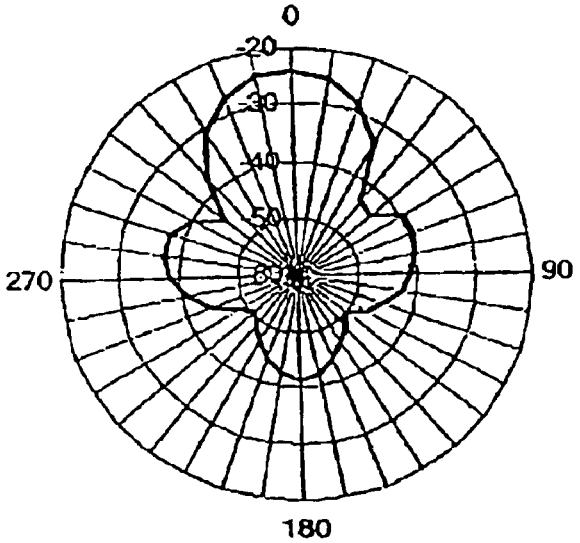

Referring now to FIGS. 2(*a*) and 2(*b*), there are shown two comparative measurements of the vertical field pattern of a vertical polarization antenna. FIG. 2(*a*) depicts a case where copper-conductor strips of 10 mm width are installed at a distance of 3 mm to dipoles which arms are 10 mm apart. The copper strips were connected to the common back-reflector. On the other hand, FIG. 2(*b*) shows a measurement of the vertical field pattern of the same antenna without such conductor strips. As is evident, the measured vertical field pattern according to FIG. 2(*a*) shows zero-elements above and below the antenna which are more than 10 dB stronger as in the case of FIG. 2(*b*).

While in the foregoing description was given with respect to a vertical polarization antenna, it is clear that the present invention can also be applied to a horizontal polarization antenna, wherein everything just has to be rotated by 90 degrees.

Best Mode of Implementing the Present Invention

The above described enhancement of the vertical field pattern of a vertical polarization antenna is presently considered to be of great value when being applied to a GSM E-OTD (Enhanced Observed Time Difference) Location Measurement Unit (according to GSM 04.71) receiver antennas which thereof enables a close installation below the BTS Transmitter antenna.

However, it is remarked that the present invention is also considered to be of great value for forthcoming technical fields to be implemented such as transmission devices of the $3^{rd}$ generation of mobile telephony.

What is described above is a device for transferring electromagnetic waves, comprising at least one element 32, 33 for transceiving electromagnetic waves, wherein such an element includes a member for transceiving electromagnetic waves and a member for feeding said transceiving member, and both members are electrically connected with each other, and a conductor strip which is bent around each of said transceiving elements so that sources of unwanted radiation pattern along said transceiving elements are covered, said conductor strip having a flat shape so that regarding its cross section, a thickness perpendicular to said transceiving element is small with respect to a dimension of said conductor strip parallel to said transceiving element, the extension of which dimension also suffices to cover said unwanted sources, wherein each of said conductor strips is grounded at both ends to a common electrical point.

As is understood from the present description by those who are skilled in the art, the present invention can be applied to many technical fields, and changes and modifications may be effected to the presently preferred embodiments without departing from the scope of the appended claims.

What is claimed is:

1. A device for transferring electromagnetic waves, comprising at least one element (32, 33) for transceiving electromagnetic waves, wherein such an element includes a member for transceiving electromagnetic waves and a member for feeding said transceiving member, and both members are electrically connected with each other, characterized by a conductor strip (101; SDCS, MDCS) which is bent around each of said transceiving elements so that sources of unwanted radiation pattern along said transceiving elements are covered, said conductor strip having a flat shape so that regarding its cross section, a thickness perpendicular to said transceiving element is small with respect to a dimension of said conductor strip parallel to said transceiving element, the extension of which dimension also suffices to cover said unwanted sources, wherein each of said conductor strips is grounded at both ends to a common electrical point.

2. A device for transferring electromagnetic waves according to claim 1, wherein the distance between said conductor strip and a source of unwanted radiation is less than half the width of said strip.

3. device for transferring electromagnetic waves according to claim 2, wherein in case of several transceiving members, they are combined in phase, and said strips are grounded at both ends by being directly connected to said grounding element.

4. A device for transferring electromagnetic waves according to claim 1, further comprising a grounding element.

5. A device for transferring electromagnetic waves according to claim 4, wherein said grounding element acts as a reflector with respect to the transceived electromagnetic waves.

6. A device for transferring electromagnetic waves according to claim 1, wherein said conductor strips are coupled to ground.

7. A device for transferring electromagnetic waves according to claim 1, wherein said conductor strips are electrically connected together through a suitable phase shift according to a phase difference of the transceiving elements.

8. A device for transferring electromagnetic waves according to claim 1, wherein one or more of said transceiving elements comprise multiple transceiving members and one feeding member electrically connected thereto.

9. A device for transferring electromagnetic waves according to claim 8, wherein the distance between said conductor strip and a corresponding source of unwanted radiation is less than half the width of said strip at each of said sources.

10. A device for transferring electromagnetic waves according to claim 1, wherein said transceiving members are dipoles and said multiple transceiving members are multiple dipoles, so that said device for transferring electromagnetic waves forms an antenna.

11. A device for transferring electromagnetic waves according to claim 10, wherein said antenna is a vertical polarization antenna.

12. A device for transferring electromagnetic waves according to claim 10, wherein said antenna is a horizontal polarization antenna.

* * * * *